United States Patent [19]

McGrath

[11] Patent Number: 4,721,966

[45] Date of Patent: Jan. 26, 1988

[54] PLANAR THREE-DIMENSIONAL CONSTRAINED LENS FOR WIDE-ANGLE SCANNING

[75] Inventor: Daniel T. McGrath, Bedford, Mass.

[73] Assignee: The United States of America as represented by the Secretary of the Air Force, Washington, D.C.

[21] Appl. No.: 861,465

[22] Filed: May 2, 1986

[51] Int. Cl.[4] ..... H01Q 19/06; H01Q 13/10

[52] U.S. Cl. ..... 343/754; 343/700 MS; 343/753

[58] Field of Search ..... 343/700 MS File, 753, 343/754, 846, 909

[56] References Cited

U.S. PATENT DOCUMENTS

| | | | |
|---|---|---|---|
| 4,131,892 | 12/1978 | Munson et al. | 343/700 MS |
| 4,263,598 | 4/1981 | Bellee et al. | 343/700 MS |
| 4,316,194 | 2/1982 | De Santis et al. | 343/700 MS |
| 4,329,689 | 5/1982 | Yee | 343/700 MS |
| 4,381,509 | 4/1983 | Rotman et al. | 343/754 |

FOREIGN PATENT DOCUMENTS

| | | | |
|---|---|---|---|
| 2037085 | 5/1980 | United Kingdom | 343/754 |

OTHER PUBLICATIONS

Rotman, W., and Turner, R. F. (1963) Wide-Angle Microwave Lens for Line Source Applications, *IEEE Trans., Antenna Propag.*, pp. 623–632.

D. H. Archer, "Lens-Fed Multiple Beam Arrays," *Microwave Journal, Sep. 1984, pp. 171–195.*

J. B. J. Rao, "Multifocal Three-Dimensional Bootlace Lenses," *IEEE Transactions on Antennas and Propagation,* Nov. 1982, pp. 1050–1056.

*Primary Examiner*—William L. Sikes

*Assistant Examiner*—Doris J. Johnson

*Attorney, Agent, or Firm*—William G. Auton; Donald J. Singer

[57] ABSTRACT

A planar microwave beamforming lens system achieves wide-angle scanning using a planar lens by using a design in two degrees of freedom. One degree of freedom is provided by varying lengths of transmission lines between aperture side elements and feed side elements as a function of radius. A second degree of freedom results from the distribution of feed side elements so that they are displaced radially from their corresponding aperture elements as a function of the radius of the planar lens. All aperture antenna elements are regularly distributed over the aperture side of the planar lens.

3 Claims, 4 Drawing Figures

PLANAR THREE-DIMENSIONAL CONSTRAINED LENS FOR WIDE-ANGLE SCANNING

STATEMENT OF GOVERNMENT INTEREST

The invention described herein may be manufactured and used by or for the Government for governmental purposes without the payment of any royalty thereon.

BACKGROUND OF THE INVENTION

The present invention relates generally to beam forming lenses used with antennas which scan electronically in azimuth and elevation, and more specifically to a planar microwave array lens.

Curved reflectors and lenses are both commonly used as collimating elements in high-gain, narrow beam microwave antennas. The choice between a reflector or lens for a given application depends upon many factors. For example, the Rotman lens is considered the optimum beamformer for producing time-delay steered beams over wide angles, but its requirement of a curved back face prohibits application to some problems, most notably those requiring large planar arrays. For a good description of the Rotman lens technology, see the discussion published in Rotman, W., and Turner, R. F. (1963) "Wide-angle microwave lens for line source applications", IEEE Trans. Antenna Propag., pp. 723–632, the disclosure of which is incorporated by reference.

Alternatives to the Rotman lens include curved wide-angle lenses and planar lenses. These lens systems are known in the art, and each possess advantages and disadvantages. For example, a planar lens (with a planar front surface which is parallel to a planar back surface) is incapable of wide-angle scanning, because the elements of the back face are normally placed directly behind the front face elements. Curved wide-angle lenses are heavy and expensive to build.

From the foregoing discussion, it is apparent that a scanning lens antenna which uses a planar lens, yet is capable of performing wide-angle scanning would be a welcome addition to the art of beamforming lens design. The present invention is intended to provide a new design which uses a planar lens, yet is capable of wide-angle scanning.

SUMMARY OF THE INVENTION

The present invention is a beamforming lens system for use with an antenna which is electronically steered. This beamforming lens system is broadly composed of: a planar lens, which houses a plurality of antenna elements on each face which are each electronically connected to corresponding feed elements by transmission lines whose lengths vary as a function of radius.

The planar lens has two planar surfaces. One of the planar surfaces is an aperture side, and houses aperture side elements which are regularly spaced, and collect radio frequency energy and route it along transmission lines to feed side elements.

The planar lens of the present invention differs from the conventional planar lens in that each feed side element is not directly behind the aperture side element, but is displaced radially a distance $(\rho - r)$. Also, each pair of transmission lines has a slightly different total length. By distributing the feed side elements in a manner that varies as a function of radius, and by further varying the lengths of the transmission lines as a function of radius, two degrees of freedom result. Feed elements corresponds to the minimum-aberration focal surface, which is unique to the lens design. Scanning is accomplished by switching between feed elements, since each of them will produce a beam directed at a different angle in azimuth and elevation.

The result of the design of the present invention is that although both faces of the lens are planar, it is still capable of wide-angle scanning. This property is due to a unique combination of two geometric "degrees of freedom" described above.

It is an object of the present invention to provide a beamforming lens design which uses a planar lens, yet is capable of wide-angle scanning.

It is another object of the present invention to provide a beamforming lens system which, when combined with an array feed, can be used for applications that require multiple beams and/or electronic scanning, such as satellite communication antennas.

These objects together with other objects, features and advantages of the invention will become more readily apparent from the following detailed description when taken in conjunction with the accompanying drawings wherein like elements are given like reference numerals throughout.

DETAILED DESCRIPTION OF THE PREFERRED EMBODIMENT

The present invention is a planar microwave array beamforming lens system. This system includes a planar lens which contains aperture elements which are electrically connected by transmission lines to corresponding feed side elements in a manner which results in the degrees of freedom necessary to allow wide-angle scanning. Although the physical shape of the lens is planar, two degrees of freedom are provided as follows. First, although the aperture side elements are regularly spaced, the feed side elements are displaced radially so that they are not directly behind their front face elements. Secondly, the transmission lines between the aperture elements and feed elements have lengths which are varied as a function of radius. The specific details of the geometry of the preferred embodiment are discussed below.

Figure 1:
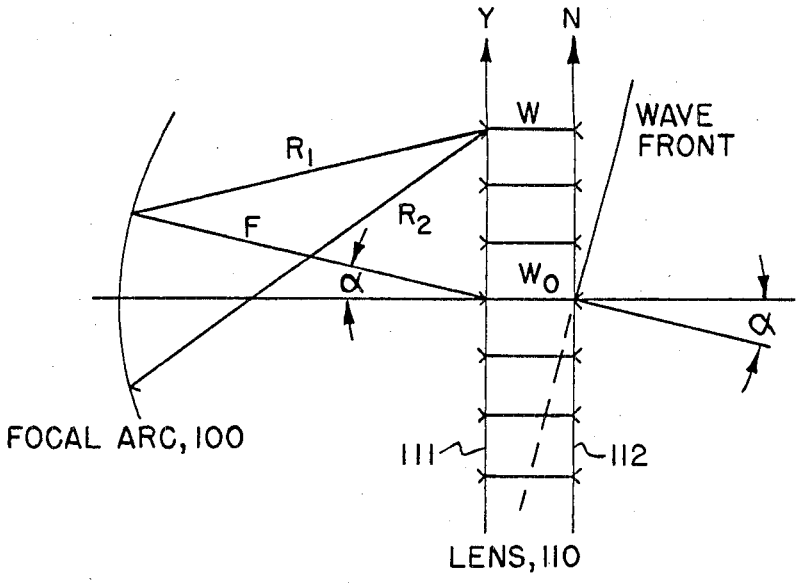
FIG. 1 is an illustration of a beamforming lens system with linear lens geometry.

The reader's attention is now directed towards FIG. 1, which is an illustration of the linear lens geometry of a beamforming lens system with one degree of freedom. The beamforming lens system of FIG. 1 includes a planar lens 110 with a distribution of antenna elements on its aperture side 112 and feed side 111, and focal arc 100 as illustrated.

In the system of FIG. 1, the elements on opposing lens surfaces have the same lateral locations, that is $Y=N$, and are joined by transmission lines of varying length, W. Through the heuristic argument that there can be only as many perfect focal points as there are degrees of freedom it is known that this lens can only have one focus because its only degree of freedom is in the line lengths. But one can prove this by attempting to find a W(y) that yields two focal points, as follows:

The point source at (F cos $\alpha$, F sin $\alpha$) in FIG. 1 is to produce a plane wave directed at an angle $\alpha$ from broadside. Hence the path length from that point to any point on the wavefront must be constant:

$$R_1+W+N\sin\alpha=F+W_o, \tag{1}$$

It is desirable for the second point to produce a wavefront directed at $-\alpha$ and therefore $$R_2+W-N\sin\alpha=F+W_o. \tag{2}$$

The distances $R_1$ and $R_2$ are $$R_1=[F^2+Y^2-2YF\sin\alpha]^{\frac{1}{2}} \tag{3}$$

$$R_2=[F^2+Y^2+2YF\sin\alpha]^{\frac{1}{2}} \tag{4}$$

Solving Eqs. (1) and (2) simultaneously with Y=N:

$$2Y\sin\alpha=[F^2+Y^2+2YF\sin\alpha]^{\frac{1}{2}}-[F^2+Y^2-2YF\sin\alpha]^{\frac{1}{2}} \tag{5a}$$

$$2Y^2\sin^2\alpha=F^2+Y^2-[F^4+Y^4+2Y^2F^2-4Y^2F^2\sin^2\alpha]^{\frac{1}{2}} \tag{5b}$$

$$(F^2+Y^2-2Y^2\sin^2\alpha)^2=F^4+Y^4+2Y^2F^2-4Y^2F^2\sin^2\alpha. \tag{5c}$$

Carrying out the square on the left and simplifying leaves $$\sin^4\alpha=\sin^2\alpha \tag{6}$$

which can only be true if $\alpha=90°$ or if $\alpha=0$ (that is, one focal point).

Figure 2:
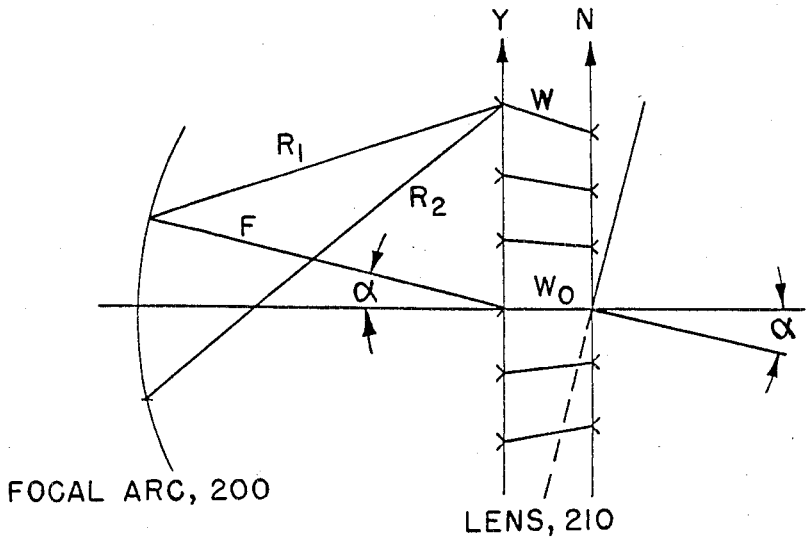
FIG. 2 is an illustration of a beamforming lens system which provides two degrees of freedom.

The preferred embodiment of the present invention differs from the system portrayed in FIG. 1, in that the feed side elements are allowed to be at different radial locations than those elements on the aperture side. FIG. 2 is an illustration of such a system which has a lens geometry which provides two degrees of freedom. This geometry is discussed below.

If we now allow the feed elements to be at different lateral locations than those on the aperture side, as in FIG. 2, or Y≠N then Eq. (5) becomes $$2N\sin\alpha=[F^2+Y^2+2YF\sin\alpha]^{\frac{1}{2}}-[F^2+Y^2-2YF\sin\alpha]^{\frac{1}{2}} \tag{7a}$$

$$2N^2\sin^2\alpha=F^2+Y^2-[F^4+Y^4+2Y^2F^2-4Y^2F^2\sin^2\alpha]^{\frac{1}{2}} \tag{7b}$$

$$(F^2+Y^2-2N^2\sin^2\alpha)^2=F^4+Y^4+2Y^2F^2-4Y^2F^2\sin^2\alpha \tag{7c}$$

$$-N^4\sin^2\alpha+Y^2N^2+F^2N^2=Y^2F^2 \tag{7d}$$

and finally, $$Y=N\left[\frac{F^2-N^2\sin^2\alpha}{F^2-N^2}\right]^{\frac{1}{2}} \tag{8}$$

which has solutions for all choices of $\alpha$. Next, solving Eqs. (1) and (2) for W:

$$W=F+W_0=\frac{1}{2}R_1-\frac{1}{2}R_2 \tag{9}$$

-continued $$=F+W_0-\frac{1}{2}[F^2+Y^2-2YF\sin\alpha]^{\frac{1}{2}}-\frac{1}{2}[F^2+Y^2+2YF\sin\alpha]^{\frac{1}{2}}$$

Equation (8) gives the position of feed side elements Y in terms of those on the aperture side, N. Then using Equation (9) to find the line lengths completes the lens design, which will have two perfect focal points at angles $\alpha$ and $-\alpha$ at a distance F from the center of the lens.

Figure 3:
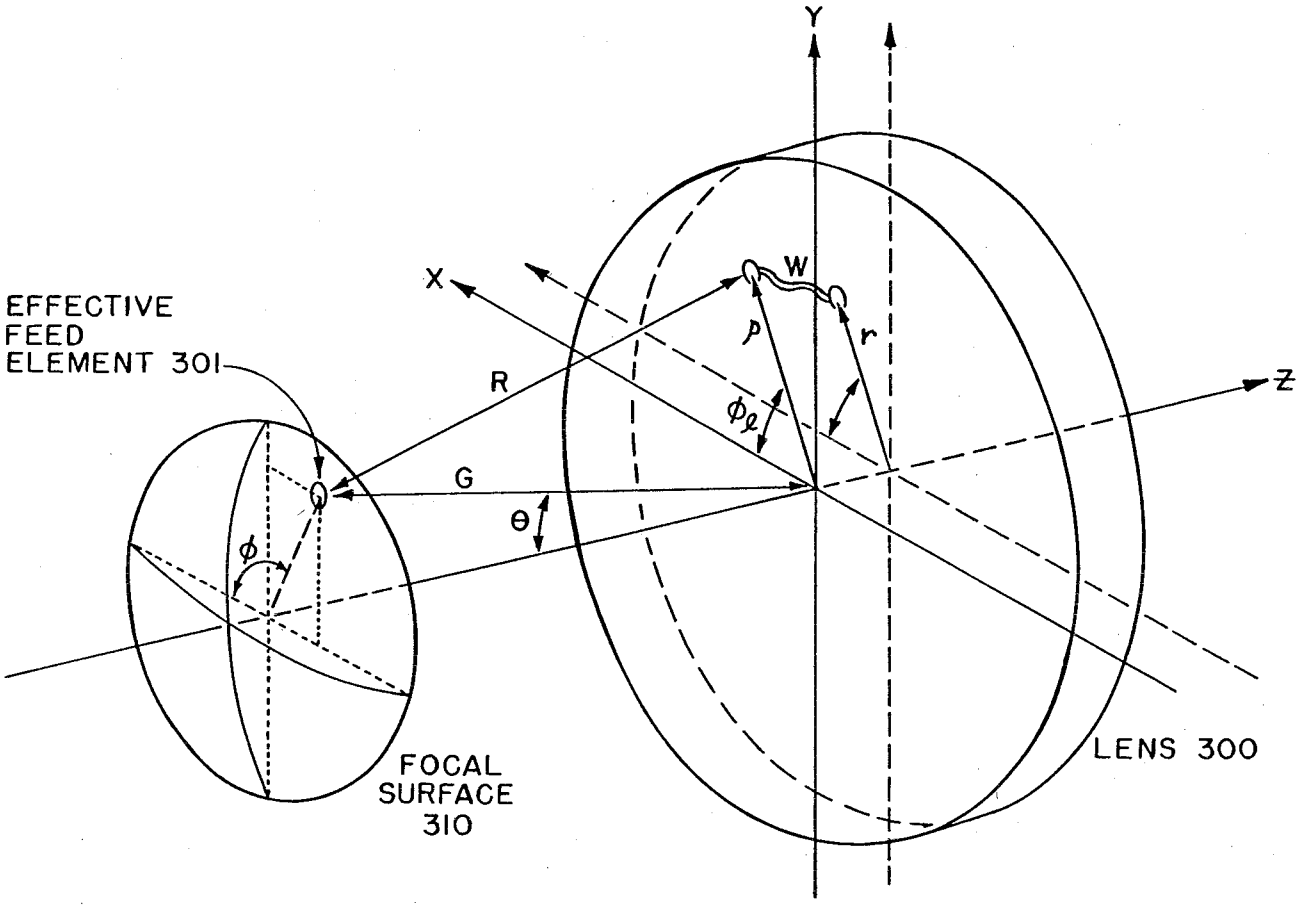
FIG. 3 is an illustration of the preferred embodiment of the present invention.

The reader's attention is now directed towards FIG. 3, which is an illustration of the preferred embodiment of the present invention. The beamforming lens system of FIG. 3 includes a planar lens 300, which contains antenna elements which have distributions and variations of transmission line lengths that simulate a distribution of effective feed elements 301 distributed over a concave focal surface 310.

The lengths of transmission line joining elements of opposing faces varies as a function of radius, and the back face elements are displaced radially (they are not directly behind their corresponding front face elements). The amount of that displacement is also a function of radius. Complete details are given in the discussion presented below.

The three equations below give (1) the position $\rho$, of a back face element in terms of position, r, of the front face element, and on-axis focal length F, and the perfect focus angle $\theta_o$; (2) the electrical length, W, of transmission line connecting the two elements ($W_o$ is an arbitrary constant); and (3) the distance, G, from any point on the optimum focal surface to the center of the lens' back face, which determines the shape of the focal surface.

$$\rho=r\left[\frac{F^2-r^2\sin^2\theta_0}{F^2-r^2}\right]^{\frac{1}{2}} \tag{10}$$

$$W=W_0-.5\sqrt{F^2+\rho^2-2\rho F\sin\theta_0}-.5\sqrt{F^2+\rho^2+2\rho F\sin\theta_0} \tag{11}$$

$$G(\theta)=F\left[1+\frac{.25\sin^2\alpha\sin^2\theta}{(1-\sec\alpha)(1+\sin\alpha\sin\theta/\sqrt{2})}\right] \tag{12}$$

where $\alpha=\sin^{-1}(a/F)$, a=aperture radius.

As stated above, the back face elements are not directly behind their corresponding front face elements. More specifically, Equation 10 defines the variation of the radius of the back face elements (feed side elements) with respect to the radius "r" of its corresponding front face (aperture side) element. That is, if the front face element has a radius of r, the back face element has a different radius $\rho$ which is defined by Equation 10, and which does not equal r. The results of the variation of the feed elements as a function of the radius is the production of the change in the electrical length W of the transmission line as given in Equation 11. This produces the change of the focal angle, as given above in Equation 12. The reasons for this change are discussed below.

The above-cited reference of Rotman and Turner provides a description of the Rotman lens principle. That is, an increase in the transmission line length between an outer lens contour point, and an inner lens contour point produces a corresponding increase in phase in an electrical signal as it travels between the outer and inner points. For example, if the transmission line increases by one-half a wavelength, the phase of the signal will increase by 180 degrees. Rotman and Turner correlate the changes with the transmission line lengths $W_o$ directly with the resultant focal arc in wide-angle lens applications. The principles of the Rotman lens are used in the present invention, with the following modifications discussed below.

The Rotman lens, of the above-cited Rotman and Turner reference, is a curved lens which relies upon the contour of the curve to provide the changes in length of the transmission lines between the front and back side of the lens. The present invention produces the changes in transmission line lengths of Equation 11 by the changes in the radial distribution of the feed antenna elements of Equation 10. The wide angle performance of the resultant focal arc are a natural concomitant, consequent, and result of the carefully selected adjustments of transmission line length, as discussed in the Rotman and Turner reference.

Figure 4:
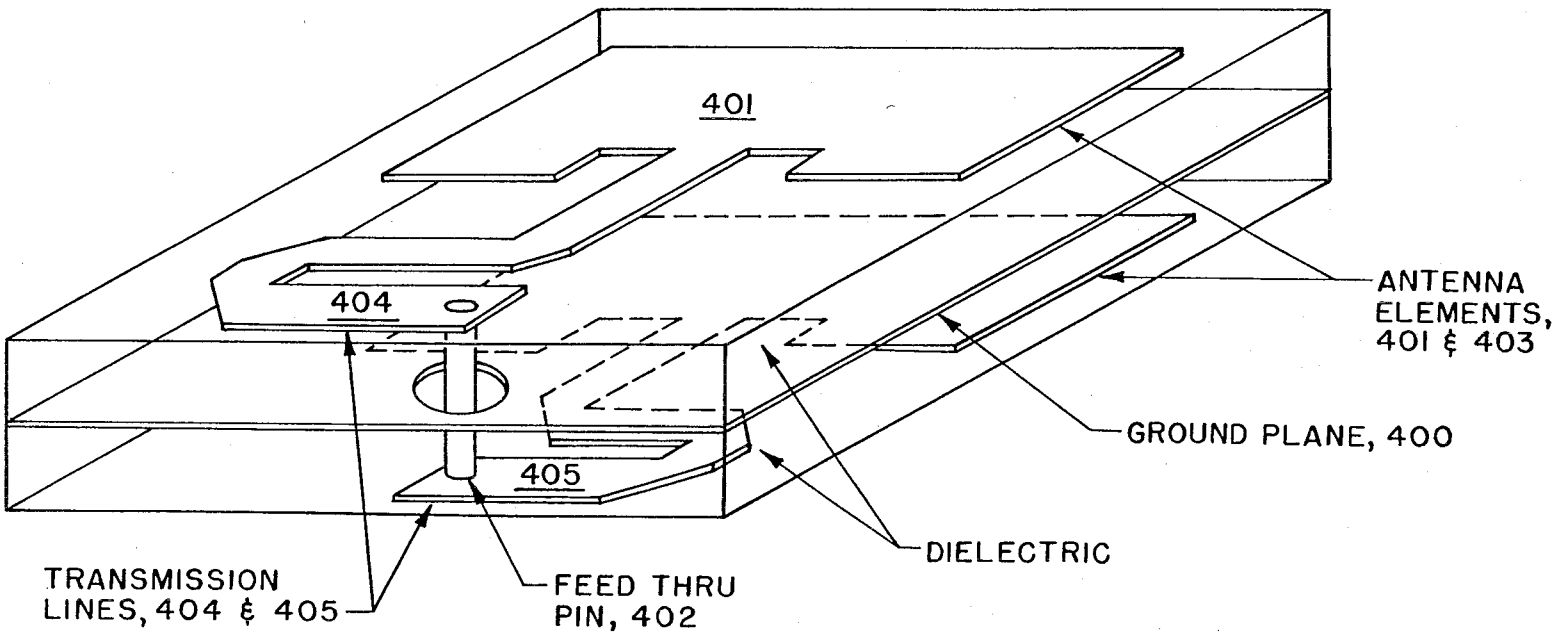
FIG. 4 is a perspective view of a section of microstrip of the lens of the present invention.

FIG. 4 is a perspective view of a section of microstrip constrained lens which is fabricated to form the specific embodiment of the invention depicted in FIG. 3. It is made up of two printed circuit arrays with elements facing in opposite directions above a common ground plane 400. Each feed side element 401 has a transmission line 404 which is connected by a feed through 402 to the aperture side element 403.

When the lens of FIG. 4 functions as a receiving antenna, the aperture side element collects radio frequency energy and routes it along the top transmission line 404 and down the feed thru hole to the bottom transmission line 405. The feed side element 401 then re-radiates that energy toward the feed. For a transmitting antenna, that sequence is reversed.

The aperture side array is photoetched on a double-side copper-clad printed circuit board. Small holes for the feed-thru's are etched on the other side. The feed side array, etched on a single-clad board, is placed back to back with the first board, as shown in FIG. 4.

A two-degree-of-freedom lens, in which the positions of aperture and feed side elements are different, allows substantially better off-axis performance than the single-degree-of-freedom design. It allows synthesis of low-sidelobe patterns out to ±10° from broadside or better with a very small number of feed elements. Although its focusing properties cannot match those of a Rotman lens, both faces of the lens are planar, which will make fabrication easier, particularly for very large aperture antennas.

The planar lens design described above uses only two of possible three degrees of freedom since variation of element positions in radius only is allowed. Variation in angle $\phi$ may yield still better performance, and should be studied. This invention has potential application to limited-scan antennas, most notably multiple-beam satellite communications antennas.

While the invention has been described in its presently preferred embodiment it is understood that the words which have been used are words of description rather than words of limitations and that changes within the purview of the appended claims may be made without departing from the scope and spirit of the invention in its broader aspects.

What is claimed is:

1. A planar microwave array beamforming lens system comprising:

a planar lens which has an aperture side and a feed side, and which houses a ground plane;

a plurality of aperture antenna elements which are housed upon said aperture side of said planar lens, said aperture antenna elements being regularly distributed over said aperture side;

a plurality of feed antenna elements which are housed upon said feed side of said planar lens with a distribution that varies as a function of radius to provide a first degree of freedom to said microwave array beamforming lens system; wherein said distribution of said plurality of feed antenna elements is given by the equation:

$$\rho = r\left(\frac{F^2 - r^2\sin^2\theta_o}{F^2 - r^2}\right)^{\frac{1}{2}}$$

where r equals the distribution of an aperture antenna element in terms of its radial location on the aperture side of the planar lens;

$\theta_o$ equals a focal angle of the planar lens;

$\rho$ equals the distribution of a feed antenna element in terms of its radial location on the feed side of the planar lens; and F is the local length of the planar lens, which is the distance from the optical center of the lens to its focus;

a plurality of aperture side transmission lines with lengths that vary as a function of radius of said planar lens to help provide a second degree of freedom in said planar microwave array beamforming lens, each of said plurality of aperture side transmission lines being electrically connected to one of said aperture side antenna elements;

a plurality of feed side transmission lines with lengths that vary as a function of radius of said planar lens to help provide said second degree of freedom, each of said plurality of feed side transmission lines being electrically connected to one of said feed side antenna elements; and a plurality of feed through pins, each of which are electrically connected between one of said aperture transmission lines and one of said feed antenna elements.

2. A planar microwave beamforming lens system, as defined in claim 1, wherein said lengths of said aperture and feed transmission lines have a combined electrical length of W which is defined by the equation:

$$W = W_0 - .5\sqrt{F^2 + \rho^2 F\sin\theta_0} - .5\sqrt{F^2 + \rho^2\rho F\sin\theta_0}$$

where $W_o$ is a design constant and W varies as a function of radius of the planar lens to allow wide-angle scanning by the microwave array beamforming lens system.

3. A planar microwave array beamforming lens system, as defined in claim 2, wherein said planar lens is given a concave focal surface which has a distance of G from any point on its optimum focal surface to the center of said feed side of said planar lens, where the distance G is given by the equation:

$$G(\theta) = F\left(1 + \frac{.25\sin^2\alpha\sin^2\theta}{(1 - \sec\alpha)(1 + \sin\alpha\sin\theta/2)}\right)$$

where $\alpha$ equals $\sin^{-1}(a/F)$; and $\alpha$ equals aperture radius of the planar lens.

* * * * *